US010529272B2

(12) United States Patent
Kim et al.

(10) Patent No.: US 10,529,272 B2
(45) Date of Patent: Jan. 7, 2020

(54) DISPLAY APPARATUS AND METHOD OF DRIVING THE SAME

(71) Applicant: Samsung Display Co., Ltd., Yongin-Si, Gyeonggi-Do (KR)

(72) Inventors: Kang-Min Kim, Hwaseong-si (KR); Mira Gwon, Daejeon (KR); Nam Heon Kim, Seongnam-si (KR); Hasook Kim, Hwaseong-si (KR); Junghwan Yi, Hwaseong-si (KR); Sunkyo Lim, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 65 days.

(21) Appl. No.: 15/969,016

(22) Filed: May 2, 2018

(65) Prior Publication Data

US 2019/0043413 A1 Feb. 7, 2019

(30) Foreign Application Priority Data

Aug. 1, 2017 (KR) ..... 10-2017-0097834

(51) Int. Cl.

| | |
|---|---|
| ***G09G 3/20*** | (2006.01) |
| ***G09G 3/36*** | (2006.01) |
| ***G09G 3/3266*** | (2016.01) |

(52) U.S. Cl.

CPC ..... *G09G 3/2092* (2013.01); *G09G 3/3266* (2013.01); *G09G 3/3674* (2013.01); *G09G 2320/02* (2013.01); *G09G 2340/04* (2013.01); *G09G 2354/00* (2013.01); *G09G 2360/144* (2013.01)

(58) Field of Classification Search

None

See application file for complete search history.

(56) References Cited

U.S. PATENT DOCUMENTS

| | | | | |
|---|---|---|---|---|
| 9,615,076 | B2 | 4/2017 | Yoon et al. | |
| 2010/0250765 | A1* | 9/2010 | Riggert ..... | H04N 21/234363 709/231 |
| 2014/0028545 | A1 | 1/2014 | Tsai | |
| 2014/0118240 | A1 | 5/2014 | Pais | |

(Continued)

FOREIGN PATENT DOCUMENTS

| | | | |
|---|---|---|---|
| KR | 1020100128019 | A | 12/2010 |
| KR | 1020160025143 | A | 3/2016 |

*Primary Examiner* — Sepehr Azari

(74) *Attorney, Agent, or Firm* — Cantor Colburn LLP

(57) ABSTRACT

A display apparatus includes a visual information inputting part, a mode determining part, a driver and a display panel. The visual information inputting part receives an eyesight of a user and a viewing distance of the user. The mode determining part determines a pixel perception distance based on the eyesight of the user and compares the viewing distance and the pixel perception distance to select one of a normal mode and a control mode. The driver maintains a vertical resolution of an input image and a frame frequency when the normal mode is selected, and outputs gate signals to gate lines during a same horizontal period to decrease the vertical resolution and inserts a compensation frame between adjacent frames to increase the frame frequency when the control mode is selected. The display panel displays an image based on the vertical resolution and the frame frequency set by the driver.

20 Claims, 13 Drawing Sheets

(56) References Cited

U.S. PATENT DOCUMENTS

| | | | | |
|---|---|---|---|---|
| 2015/0109192 | A1* | 4/2015 | Huang | G06F 3/013 345/156 |
| 2015/0179149 | A1* | 6/2015 | Park | G06F 3/013 345/698 |
| 2015/0248210 | A1* | 9/2015 | Lee | H04N 21/44218 345/593 |
| 2016/0063965 | A1 | 3/2016 | Yoo | |
| 2016/0155405 | A1* | 6/2016 | Kim | G09G 3/003 345/213 |
| 2016/0180789 | A1 | 6/2016 | Hur et al. | |
| 2016/0182594 | A1* | 6/2016 | White | H04L 65/607 709/219 |
| 2016/0210921 | A1 | 6/2016 | Hur et al. | |
| 2017/0085959 | A1* | 3/2017 | Fithian | H04N 21/6377 |
| 2017/0264891 | A1* | 9/2017 | Iwasaki | G03B 35/24 |
| 2018/0040665 | A1* | 2/2018 | Ohmae | H01L 29/41 |
| 2018/0059799 | A1* | 3/2018 | Lee | G06F 3/017 |
| 2018/0103230 | A1* | 4/2018 | Vitta | H04N 19/59 |
| 2018/0182359 | A1* | 6/2018 | Liu | G09G 5/363 |

* cited by examiner

FIG. 8

| MODE | RESOLUTION | | FRAME FREQUENCY |
|---|---|---|---|
| | VERTICAL | HORIZONTAL | |
| NORMAL | V | H | FR |
| M1 | V/2 | H | 2FR |
| M2 | V/3 | H | 3FR |
| M3 | V/4 | H | 4FR |

DISPLAY APPARATUS AND METHOD OF DRIVING THE SAME

This application claims priority to Korean Patent Application No. 10-2017-0097834, filed on Aug. 1, 2017, and all the benefits accruing therefrom under 35 U.S.C. § 119, the content of which in its entirety is herein incorporated by reference.

BACKGROUND

1. Field

Exemplary embodiments of the invention relate to a display apparatus. More particularly, exemplary embodiments of the invention relate to a display apparatus with enhanced display quality and a method of driving the display apparatus.

2. Description of the Related Art

A display apparatus, such as a liquid crystal display ("LCD") apparatus and an organic light emitting display apparatus, typically includes a display panel and a panel driver. The display panel includes a plurality of gate lines, a plurality of data lines and a plurality of pixels connected to the gate lines and the data lines. The panel driver includes a gate driver for providing gate signals to the gate lines and a data driver for providing data voltages to the data lines.

The LCD apparatus may include a first substrate including a pixel electrode, a second substrate including a common electrode and a liquid crystal layer disposed between the first and second substrate. In the LCD apparatus, an electric field is generated by voltages applied to the pixel electrode and the common electrode. In the LCD apparatus, a transmittance of a light passing through the liquid crystal layer may be adjusted by adjusting an intensity of the electric field so that a desired image may be displayed.

The organic light emitting display apparatus may display images using organic light emitting diodes ("OLEDs"). The OLED generally includes an organic layer between two electrodes, i.e., an anode electrode and a cathode electrode. Holes from the anode electrode may be combined with electrons from the cathode electrode in the organic layer between the anode electrode and the cathode electrode to emit light.

SUMMARY

Exemplary embodiments of the invention provide a display apparatus with enhanced display quality.

Exemplary embodiments of the invention also provide a method of driving the above-mentioned display apparatus to enhance a display quality of the display apparatus.

In an exemplary embodiment according to the invention, a display apparatus includes a visual information inputting part, a mode determining part, a driver and a display panel. In such an embodiment, the visual information inputting part receives an eyesight of a user and a viewing distance of the user. In such an embodiment, the mode determining part determines a pixel perception distance of the user based on the eyesight of the user and compares the viewing distance and the pixel perception distance to select one of a normal mode and a control mode. In such an embodiment, the driver maintains a vertical resolution of an input image and a frame frequency of the input image when the normal mode is selected, and outputs at least two gate signals of a plurality of gate signals to corresponding gate lines of a plurality of gate lines during a same horizontal period to decrease the vertical resolution of the input image and inserts a compensation frame between adjacent frames to increase the frame frequency of the input image when the control mode is selected. In such an embodiment, the display panel displays an image based on the vertical resolution and the frame frequency set by the driver. In such an embodiment, the pixel perception distance satisfies the following equation: $PPD=A\times CP\times PP/\tan(1/60^{\circ})$, where PPD denotes the pixel perception distance, A denotes the eyesight of the user in a decimal number, CP denotes a variable, and PP denotes a pixel pitch of the display apparatus.

In an exemplary embodiment, the mode determining part may select the normal mode when the viewing distance is less than the pixel perception distance, and may select the control mode when the viewing distance is greater than the pixel perception distance.

In an exemplary embodiment, the display panel may include the plurality of gate lines extending in a first direction, a plurality of data lines extending in a second direction crossing the first direction, and a plurality of pixels connected to the plurality of gate lines and the plurality of data lines. In such an embodiment, each of the pixels may include a plurality of subpixels, the subpixels may be disposed in the first direction in the pixel, and the driver may output the at least two gate signals to adjacent gate lines of the plurality of gate lines during the same horizontal period in the control mode.

In an exemplary embodiment, the display panel may include the plurality of gate lines extending in a first direction, a plurality of data lines extending in a second direction crossing the first direction, and a plurality of pixels connected to the plurality of gate lines and the plurality of data lines. In such an embodiment, each of the pixels may include a plurality of subpixels, the subpixels may be disposed in the second direction in the pixel, and the driver may output the at least two gate signals to gate lines connected to subpixels having a same color as each other during the same horizontal period in the control mode.

In an exemplary embodiment, the control mode may include a first mode, a second mode and a third mode.

In an exemplary embodiment, the driver may output two gate signals to two gate lines during the same horizontal period to decrease the vertical resolution of the input image to half, and may insert a single compensation frame between adjacent frames to double the frame frequency of the input image in the first mode.

In an exemplary embodiment, the driver may output three gate signals to three gate lines during the same horizontal period to decrease the vertical resolution of the input image to one third, and may insert two compensation frames between adjacent frames to triple the frame frequency of the input image in the second mode.

In an exemplary embodiment, the driver may output four gate signals to four gate lines during the same horizontal period to decrease the vertical resolution of the input image to quarter, and may insert three compensation frames between adjacent frames to quadruple the frame frequency of the input image in the third mode.

In an exemplary embodiment, the mode determining part may select one of the first mode, the second mode and the third mode based on a difference between the viewing distance of the user and the pixel perception distance.

In an exemplary embodiment, the visual information inputting part may display an eyesight test pattern to perform an eyesight test, and may determine the eyesight of the user based on a result from the eyesight test.

In an exemplary embodiment, the visual information inputting part may determine the viewing distance of the user using a camera.

In an exemplary embodiment, the visual information inputting part may receive an ambient illumination of the display apparatus and a number of users. In such an embodiment, the variable (CP) may be determined based on a resolution of the input image, the ambient illumination and the number of users, and the variable (CP) may be between 0.5 and 1.5.

In an exemplary embodiment, the pixel pitch may be defined as a length of a side of the pixel.

In an exemplary embodiment, the compensation frame may be generated by a motion estimated motion compensation ("MEMC") method using image data of the adjacent frames.

In an exemplary embodiment, the mode determining part may select one of the normal mode and the control mode to generate a mode selection signal. In such an embodiment, the driver may include a scaler which scales input image data based on the mode selection signal, a MEMC part which generates the compensation frame by a MEMC method using image data of the adjacent frames in the control mode, and an image control part which controls the vertical resolution and the frame frequency based on the mode selection signal.

In another exemplary embodiment according to the invention, the display apparatus includes a visual information inputting part, a mode determining part, a driver and a display panel. In such an embodiment, the visual information inputting part receives an eyesight of a user and a viewing distance of the user. In such an embodiment, the mode determining part determines a pixel perception distance of the user based on the eyesight of the user, and selects a control mode when the viewing distance is greater than the pixel perception distance. In such an embodiment, the driver outputs n gate signals to n gate lines during a same horizontal period to decrease a vertical resolution of an input image by 1/n, and inserts (n−1) compensation frames between adjacent frames to increase a frame frequency of the input image by n times, when the control mode is selected, where n is a positive integer greater than 1. In such an embodiment, the display panel displays an image based on the vertical resolution and the frame frequency set by the driver. The pixel perception distance satisfies the following equation: $PPD=A\times CP\times PP/\tan(1/60°)$, where PPD denotes the pixel perception distance, A denotes the eyesight of the user in a decimal number, CP denotes a variable, and PP denotes a pixel pitch of the display apparatus.

In another exemplary embodiment according to the invention, a method of driving a display apparatus includes receiving an eyesight of a user and a viewing distance of the user, determining a pixel perception distance of the user based on the eyesight of the user, comparing the viewing distance of the user and the pixel perception distance to select one of a normal mode and a control mode, displaying an image with a normal vertical resolution of an input image and a normal frame frequency of the input image when the normal mode is selected, and displaying the image with a vertical resolution lower than the normal vertical resolution by outputting at least two gate signals of a plurality of gate signals to corresponding gate lines of a plurality of gate lines during a same horizontal period and a frame frequency greater than the normal frame frequency by inserting a compensation frame between adjacent frames when the control mode is selected. In such an embodiment, the pixel perception distance satisfies the following equation: $PPD=A\times CP\times PP/\tan(1/60°)$, where PPD denotes the pixel perception distance, A denotes the eyesight of the user in a decimal number, CP denotes a variable, and PP denotes a pixel pitch of the display apparatus.

In an exemplary embodiment, the normal mode may be selected when the viewing distance is less than the pixel perception distance, and the control mode may be selected when the viewing distance is greater than the pixel perception distance.

In an exemplary embodiment, the receiving the eyesight of the user and the viewing distance of the user may include displaying an eyesight test pattern to perform an eyesight test, and determining the eyesight of the user based on a result from the eyesight test.

In an exemplary embodiment, the inserting the compensation frame between the adjacent frames may include generating the compensation frame by a MEMC method using image data of the adjacent frames.

According to exemplary embodiments of the display apparatus and the method of driving the display apparatus, a pixel perception distance is determined based on the eyesight of a user and a pixel pitch of the display apparatus, and a vertical resolution of an input image is decreased and a frame frequency is increased when a viewing distance of the user is greater than the pixel perception distance. Accordingly, in such embodiments, when the viewing distance of the user is greater than the pixel perception distance and the user may not fully perceive the resolution of the display apparatus, the vertical resolution of the input image is decreased and the frame frequency is increased. Thus, in such embodiments, a charging time of the pixel may be increased and the display panel may be driven in a high frequency such that the display quality of the display apparatus may be enhanced.

BRIEF DESCRIPTION OF THE DRAWINGS

The above and other features of the invention will become more apparent by describing in detailed exemplary embodiments thereof with reference to the accompanying drawings, in which:

FIG. 8 is a table illustrating a vertical resolution, a horizontal resolution and a frame frequency for modes;

DETAILED DESCRIPTION OF THE INVENTION

Figure 1:
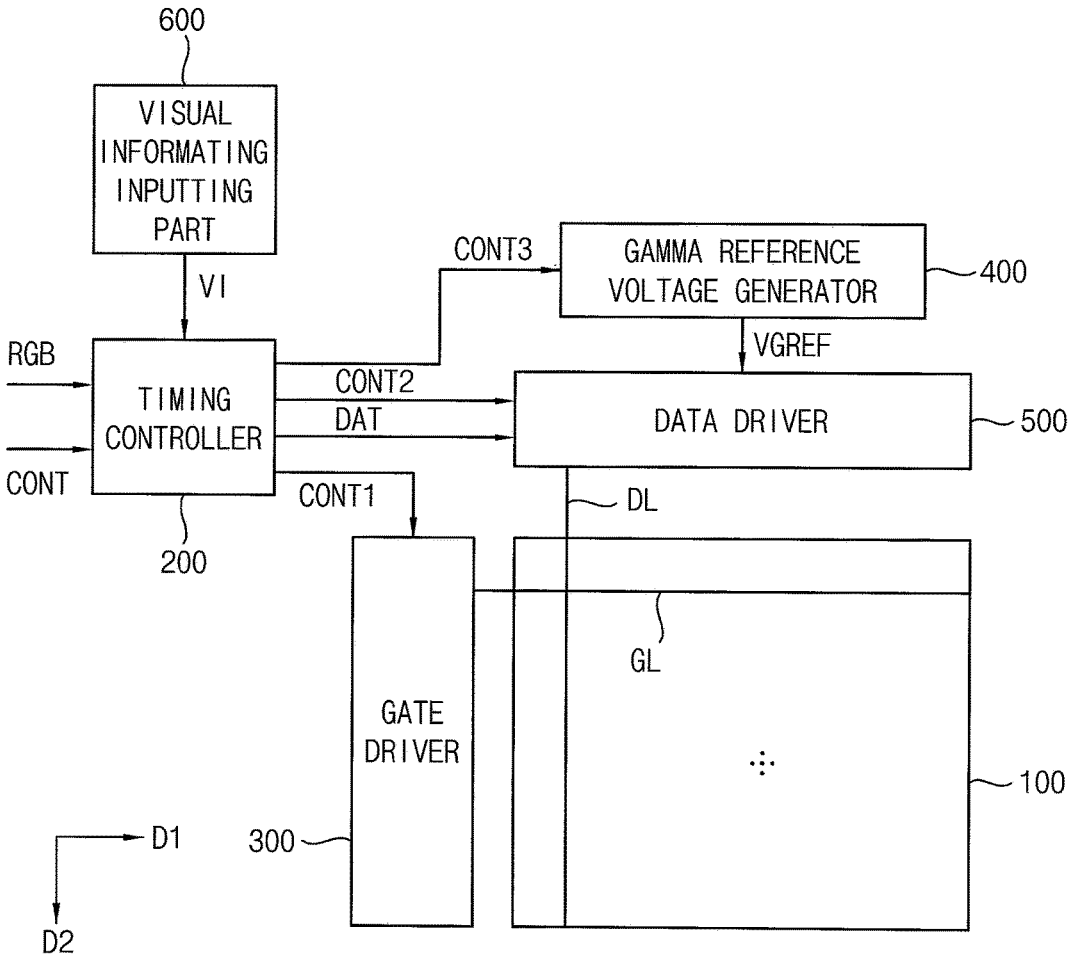
FIG. 1 is a block diagram illustrating a display apparatus according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, Exemplary embodiments of the invention will be described in detail with reference to the accompanying drawings.

FIG. 1 is a block diagram illustrating a display apparatus according to an exemplary embodiment of the invention.

Referring to FIG. 1, an exemplary embodiment of the display apparatus includes a display panel 100 and a driver. The driver includes a timing controller 200, a gate driver 300, a gamma reference voltage generator 400, a data driver 500 and a visual information inputting part 600.

The display panel 100 includes a display region for displaying an image and a peripheral region adjacent to the display region.

The display panel 100 includes a plurality of gate lines GL, a plurality of data lines DL, and a plurality of pixels electrically connected to the gate lines GL and the data lines DL. The gate lines GL extend in a first direction D1, and the data lines DL extend in a second direction D2 crossing the first direction D1.

In some exemplary embodiments, the pixels may include a switching element (not shown), a liquid crystal capacitor (not shown) and a storage capacitor (not shown). The liquid crystal capacitor and the storage capacitor may be electrically connected to the switching element. The pixels may be arranged in a matrix form.

The pixels may include a plurality of subpixels. In one exemplary embodiment, for example, the each of the pixels may include a red subpixel, a green subpixel and a blue subpixel. In an exemplary embodiment, the red subpixel, the green subpixel and the blue subpixel may be arranged in the first direction D1 in the each of the pixels. Alternatively, the red subpixel, the green subpixel and the blue subpixel may be arranged in the second direction D2 in the each of the pixels.

The structure of the pixels will be described later in greater detail referring to FIGS. 11A and 12A.

The visual information inputting part 600 may receive user's eyesight. In one exemplary embodiment, for example, the user may input the user's eyesight. Alternatively, the visual information inputting part 600 may perform eyesight test of the user to determine the user's eyesight. In one exemplary embodiment, for example, the visual information inputting part 600 may display eyesight test pattern on the display panel 100 to perform the eyesight test for the user. Alternatively, the visual information inputting part 600 may use a predetermined eyesight.

The visual information inputting part 600 may receive a viewing distance of the user. The viewing distance is a distance between the user and the display apparatus. In one exemplary embodiment, for example, the user may input the viewing distance of the user. Alternatively, the viewing distance may be determined using a camera. The camera may be a stereo camera. The camera may be a time-of-flight ("ToF") camera. Alternatively, the visual information inputting part 600 may use a predetermined viewing distance.

The visual information inputting part 600 may output visual information VI including the eyesight and the viewing distance to the timing controller 200. The visual information VI may further include an ambient illumination and the number of users.

The timing controller 200 receives input image data RGB and an input control signal CONT from an external device (not shown). The timing controller 200 receives the visual information VI from the visual information inputting part 600. The input image data RGB may include red image data R, green image data G and blue image data B. The input control signal CONT may include a data enable signal and a master clock signal. The input control signal CONT may further include a vertical synchronizing signal and a horizontal synchronizing signal.

The timing controller 200 generates a first control signal CONT1, a second control signal CONT2, a third control signal CONT3 and a data signal DAT, based on the input image data RGB, the input control signal CONT and the visual information VI.

The timing controller 200 generates the first control signal CONT1 for controlling operations of the gate driver 300 based on the input control signal CONT and the visual information VI, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT and the visual information VI, and outputs the second control signal CONT2 to the data driver 500. The second control signal CONT2 may include a horizontal start signal and a load signal.

The timing controller 200 generates the data signal DAT based on the input image data RGB and the visual information VI. The timing controller 200 outputs the data signal DAT to the data driver 500. The data signal DAT may include substantially the same image data as the input image data RGB or the data signal DAT may include compensated image data generated by compensating the input image data RGB. In one exemplary embodiment, for example, the timing controller 200 may selectively perform an image quality compensation, a spot compensation, an adaptive color correction ("ACC"), and/or a dynamic capacitance compensation ("DCC") on the input image data RGB to generate the data signal DAT including the compensated image data.

The timing controller 200 generates the third control signal CONT3 for controlling operations of the gamma reference voltage generator 400 based on the input control signal CONT and the visual information VI, and outputs the third control signal CONT3 to the gamma reference voltage generator 400.

The structure and the operation of the timing controller 200 will be described later in greater detail referring to FIG. 2.

The gate driver 300 generates gate signals for driving the gate lines GL in response to the first control signal CONT1 received from the timing controller 200. The gate driver 300 outputs the gate signals to the gate lines GL.

In some exemplary embodiments, the gate driver 300 may be disposed directly on the display panel 100, or may be connected to the display panel 100 as a tape carrier package ("TCP") type. Alternatively, the gate driver 300 may be integrated on the peripheral region of the display panel 100.

The operation of the gate driver 300 will be described later in greater detail referring to FIGS. 10, 11B and 12B.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In some exemplary embodiments, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analogue levels based on the gamma reference voltage VGREF. The data driver 500 outputs the data voltages to the data lines DL.

In some exemplary embodiments, the data driver 500 may be disposed directly on the display panel 100, or may be connected to the display panel 100 as a TCP type. Alternatively, the data driver 500 may be integrated on the peripheral region of the display panel 100.

The operation of the data driver 500 will be described later in greater detail referring to FIGS. 10, 11B and 12B.

Figure 2:
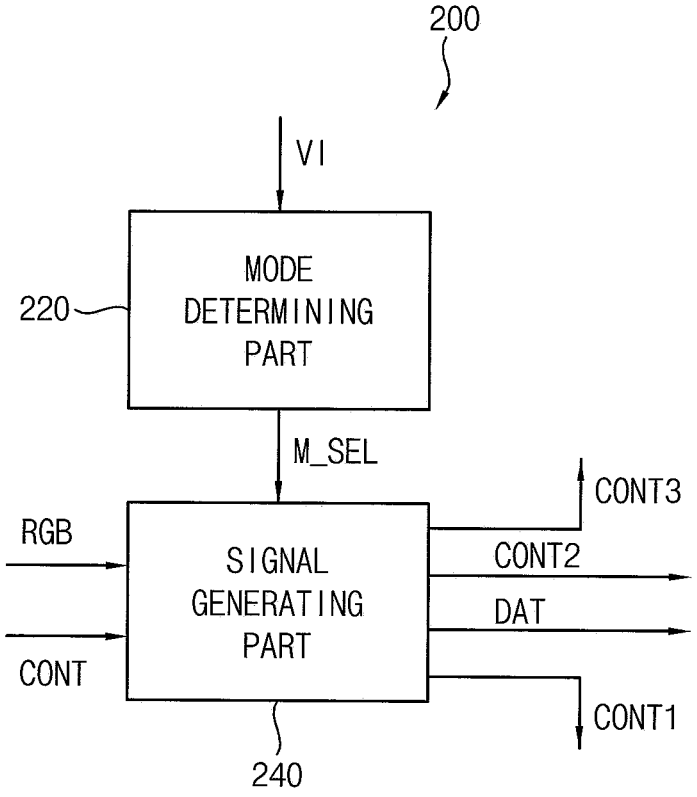
FIG. 2 is a block diagram illustrating a timing controller of FIG. 1.

FIG. 2 is a block diagram illustrating the timing controller 200 of FIG. 1.

Referring to FIGS. 1 and 2, an exemplary embodiment of the timing controller 200 includes a mode determining part 220 and a signal generating part 240.

The mode determining part 220 receives the visual information VI from the visual information inputting part 600. The visual information VI includes the user's eyesight and the viewing distance. The visual information VI may further include the ambient illumination and the number of users.

The mode determining part 220 determines a mode based on the visual information VI. In such an embodiment, a frame frequency and a vertical resolution of the display apparatus may be changed according to the mode. In such an embodiment, a lasting time of a frame and timings of the data signal DAT and the gate signals may be changed according to the mode. The mode determining part 220 outputs a mode selection signal M_SEL corresponding to the determined mode to the signal generating part 240.

A method of determining the mode based on the visual information VI by the mode determining part 220 will be described later in detail referring to FIGS. 3 to 6.

The signal generating part 240 receives the input image data RGB and the input control signal CONT and receives the mode selection signal M_SEL from the mode determining part 220.

The signal generating part 240 generates the first control signal CONT1, the second control signal CONT2, the third control signal CONT3 and the data signal DAT, based on the input image data RGB and the input control signal CONT. The signal generating part 240 may generate the first control signal CONT1, the second control signal CONT2, the third control signal CONT3 and the data signal DAT, which are varied according to the mode determined based on the mode selection signal M_SEL.

The change of the driving characteristics for the modes will be described later in greater detail referring to FIGS. 7 to 10, 11A, 11B, 12A and 12B.

Although not shown in figures, a part of the mode determining part 220 and the signal generating part 240 may be formed independently from the timing controller 200 or may be disposed outside the timing controller 200. In one exemplary embodiment, for example, the mode determining part 220 disposed outside the timing controller 200 may determine the mode, the part of the signal generating part 240 may change the driving characteristics of the input image according to the determined mode, and the timing controller 200 may receive the input image data and the input control signal, which have the changed driving characteristics corresponding to the determined mode.

Figure 3:
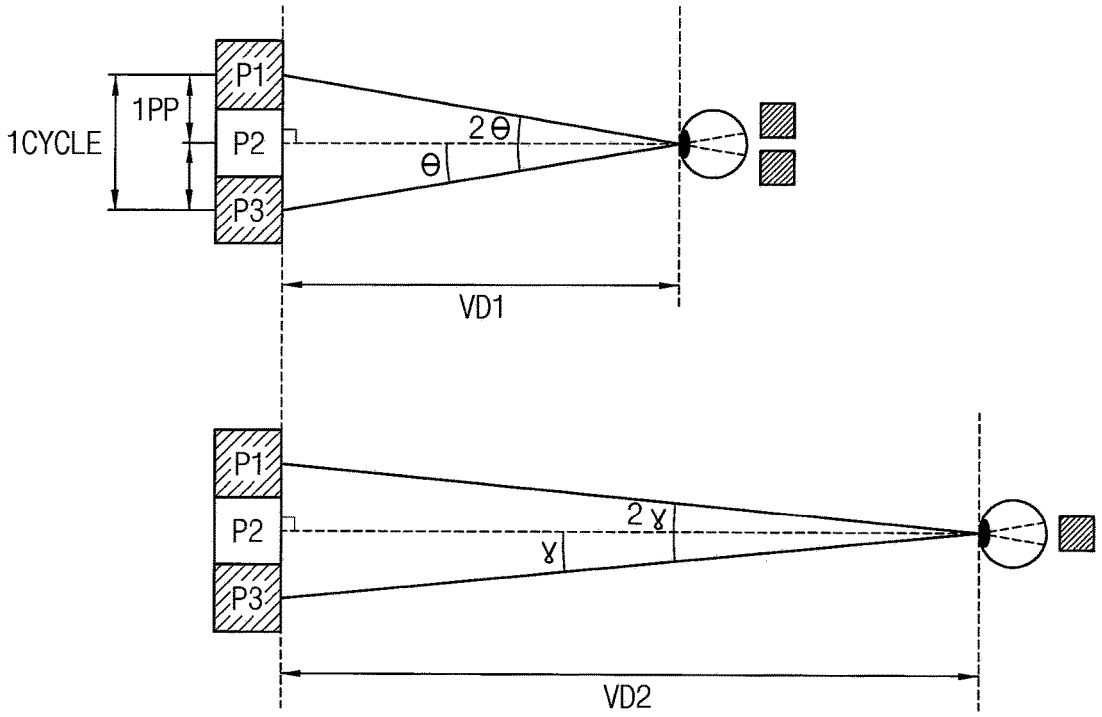
FIG. 3 is a conceptual diagram illustrating pixel perception according to a pixel perception distance and a viewing distance.
Figure 4:
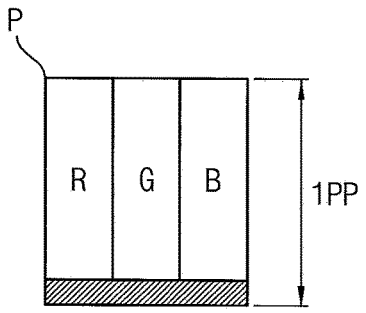
FIG. 4 is a conceptual diagram illustrating a definition of a pixel pitch.

FIG. 3 is a conceptual diagram illustrating pixel perception according to a pixel perception distance and the viewing distance. FIG. 4 is a conceptual diagram illustrating a definition of a pixel pitch.

Referring to FIGS. 3 and 4, a pixel pitch PP means a distance between centers of two adjacent unit pixels or a length of a side of a portion including a unit pixel and a black matrix portion adjacent thereto. The pixel pitch PP may have various values according to a size of the display panel and a resolution. A cycle is defined as two pixel pitches.

The resolution of the user having the eyesight of 1.0 may be 30 cycles per degree or 60 pixels per degree. The user having the eyesight of 1.0 may perceive each pixel when the 30 cycles or the 60 pixels are disposed in a viewing angle of 1°. The user having the eyesight of 1.0 may perceive each pixel, when one pixel is disposed in the 1/60°.

The pixel perception distance $PPD_{1.0}$ means the distance when the user having the eyesight of 1.0 perceives each pixel. The pixel perception distance $PPD_{1.0}$ satisfies the following equation: $PPD_{1.0}=PP/\tan(1/60°)$.

In the above equation, 'PP' denotes the pixel pitch of the display apparatus.

When the viewing distance of the user having the eyesight of 1.0 is less than the pixel perception distance $PPD_{1.0}$, the user may perceive each pixel. The pixel perception distance PPD may be varied according to the pixel pitch of the display apparatus and the user's eyesight.

In FIG. 3, the user may observe three adjacent pixels in two different viewing distance VD1 and VD2.

As shown in the upper view of FIG. 3, one cycle or two pixels may be disposed in a viewing angle of 2θ, and one pixel is disposed in a viewing angle of θ. Herein, θ is greater than 1/60°. According to the above equation, the viewing distance VD1 of the user is less than the pixel perception distance $PPD_{1.0}$. The user may perceive each of two adjacent pixels.

As shown in the lower view of FIG. 3, one cycle or two pixels may be disposed in a viewing angle of 2γ, and one pixel is disposed in a viewing angle of γ. Herein, γ is less than 1/60°. According to the above equation, the viewing distance VD2 of the user is greater than the pixel perception distance $PPD_{1.0}$. The user may not perceive each of two adjacent pixels.

In the upper view of FIG. 3, the user may perceive the resolution of the display apparatus. In this case, when the resolution of the display apparatus decreases, the user may perceive the change of the resolution. In the lower view of FIG. 3, the user may not fully perceive the resolution of the display apparatus. In this case, when the resolution of the display apparatus decreases, the user may not perceive the change of the resolution.

The pixel perception distance PPD of the user's eyesight of A may satisfy a following equation: $PPD=PPD_{1.0}\times A\times CP=A\times CP\times PP/\tan(1/60°)$.

In the above equation, 'A' denotes a user's eyesight (decimal number), and 'CP' denotes a variable.

The variable CP is a variable that varies based on a resolution of the input image, an ambient illumination of the display apparatus and the number of users. The variable CP may be set by a manufacturer. The variable CP may be in a range between 0.5 and 1.5.

Figure 5:
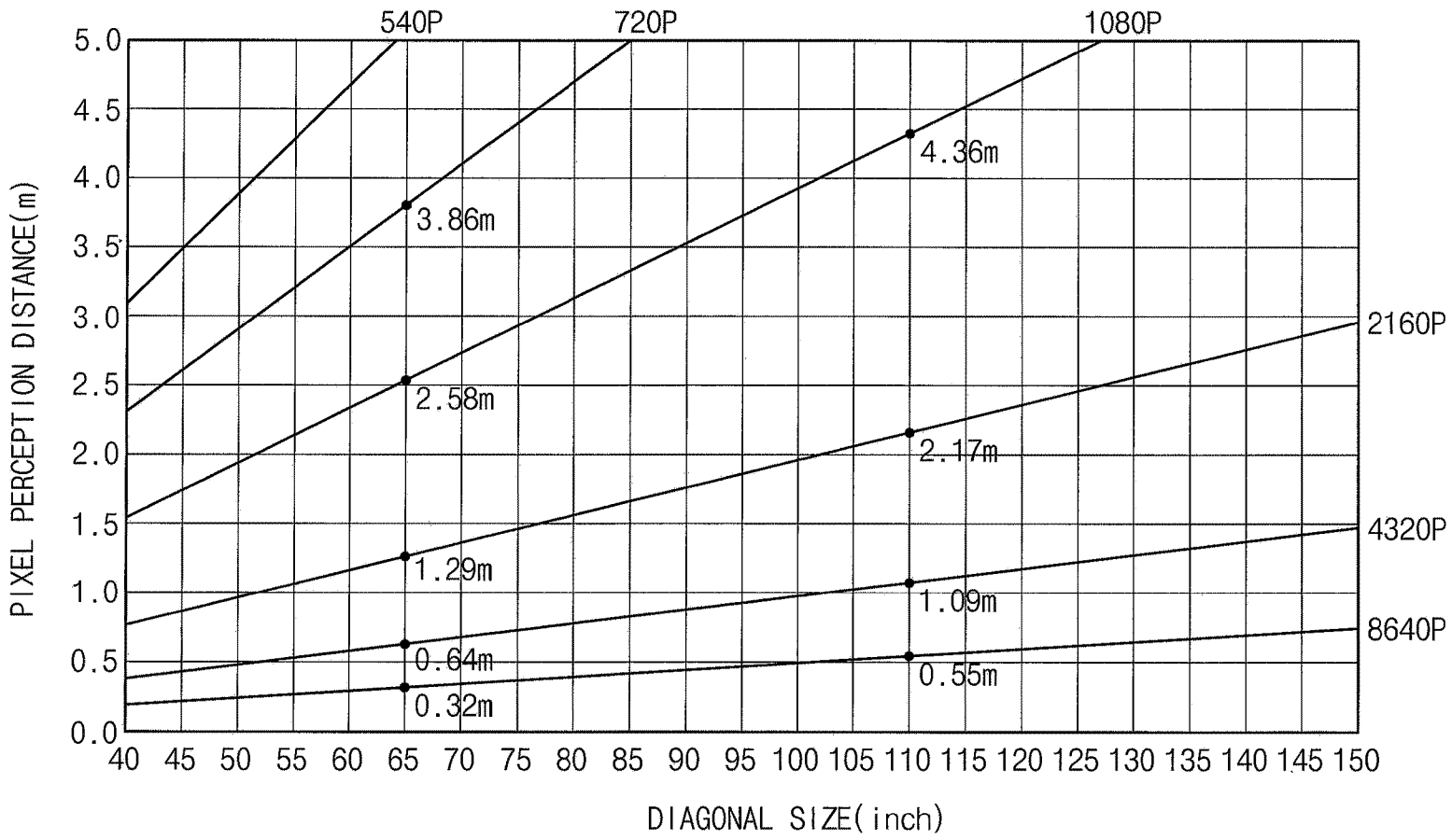
FIG. 5 is a graph illustrating a pixel perception distance according to a resolution and a diagonal size of the display panel when user's eyesight is 1.0.

FIG. 5 is a graph illustrating a pixel perception distance according to a resolution and a diagonal size of the display panel when user's eyesight is 1.0. In FIG. 5, the numbers at ends of lines indicate the resolution.

Referring to FIGS. 3 and 5, as the diagonal size of the display panel having a constant resolution increases, one pixel pitch 1PP increases so that the pixel perception distance PPD may increase. When the resolution is 1080P and the diagonal size is 65 inches, for example, the pixel perception distance PPD is 2.58 meters (m). When the resolution is 1080P and the diagonal size is 110 inches, for example, the pixel perception distance PPD is 4.36 m. When the resolution is 2160P and the diagonal size is 65 inches, for example, the pixel perception distance PPD is 1.29 m. When the resolution is 2160P and the diagonal size is 110 inches, for example, the pixel perception distance PPD is 2.17 m.

As the resolution of the display panel having a constant diagonal size increases, one pixel pitch 1PP decreases so that the pixel perception distance PPD may decrease. When the diagonal size is 65 inches and the resolution is 1080P, for example, the pixel perception distance PPD is 2.58 m. When the diagonal size is 65 inches and the resolution is 2160P, for example, the pixel perception distance PPD is 1.29 m. When the diagonal size is 110 inches and the resolution is 1080P, for example, the pixel perception distance PPD is 4.36 m. When the diagonal size is 110 inches and the resolution is 2160P, for example, the pixel perception distance PPD is 2.17 m.

When the diagonal size is 65 inches, the resolution is 2160P and the viewing distance of the user is greater than 1.29 m, the user may not fully perceive the resolution of 2160P, that is, the user may not perceive each of two adjacent pixels. Thus, in this condition, although the resolution is decreased, the user may not perceive the change of the resolution.

Figure 6:
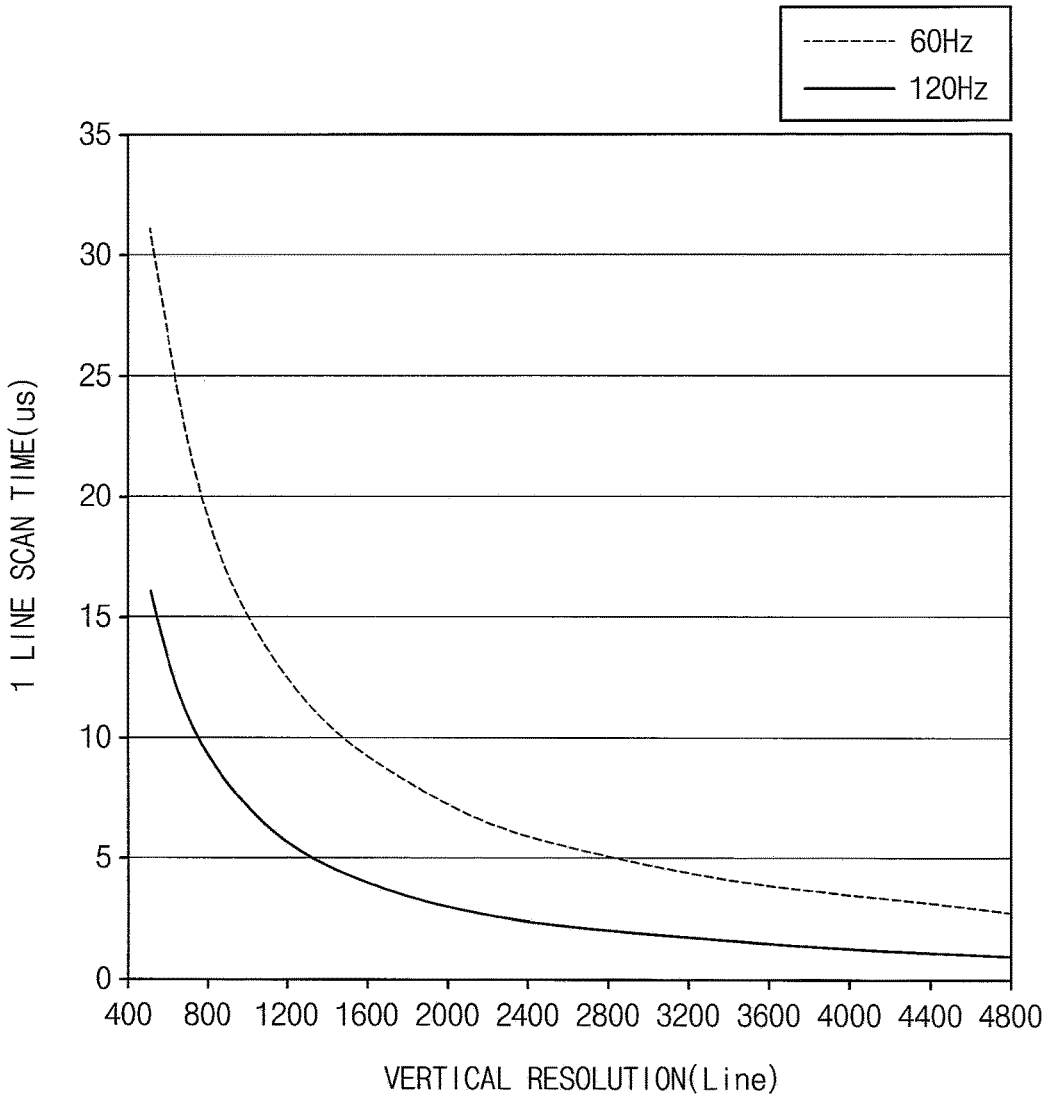
FIG. 6 is a graph illustrating a line scan time versus a vertical resolution.

FIG. 6 is a graph illustrating a line scan time versus a vertical resolution.

Referring to FIG. 6, as the vertical resolution increases, the line scan time decreases. When the vertical resolution increases, the charging time of the pixels in a horizontal line decreases.

According to an exemplary embodiment, when the viewing distance of the user is greater than the pixel perception distance PPD, the mode may be changed such that the vertical resolution is decreased and the frame frequency is increased. According to difference between the viewing distance of the user and the pixel perception distance PPD, the various modes having various vertical resolutions and various frame frequencies may be set.

Figure 7:
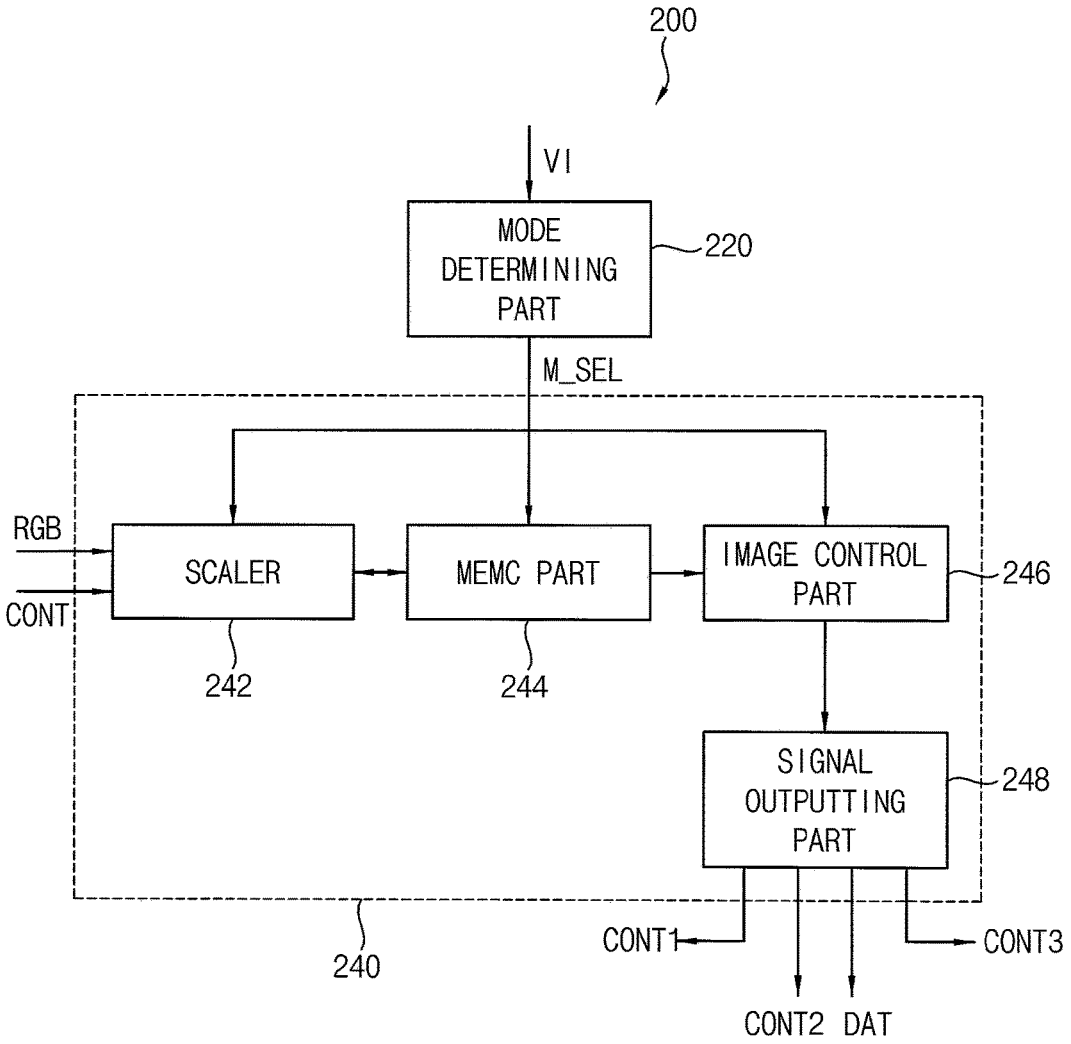
FIG. 7 is a block diagram illustrating a timing controller of a display apparatus according to an exemplary embodiment of the invention.
Figure 9:
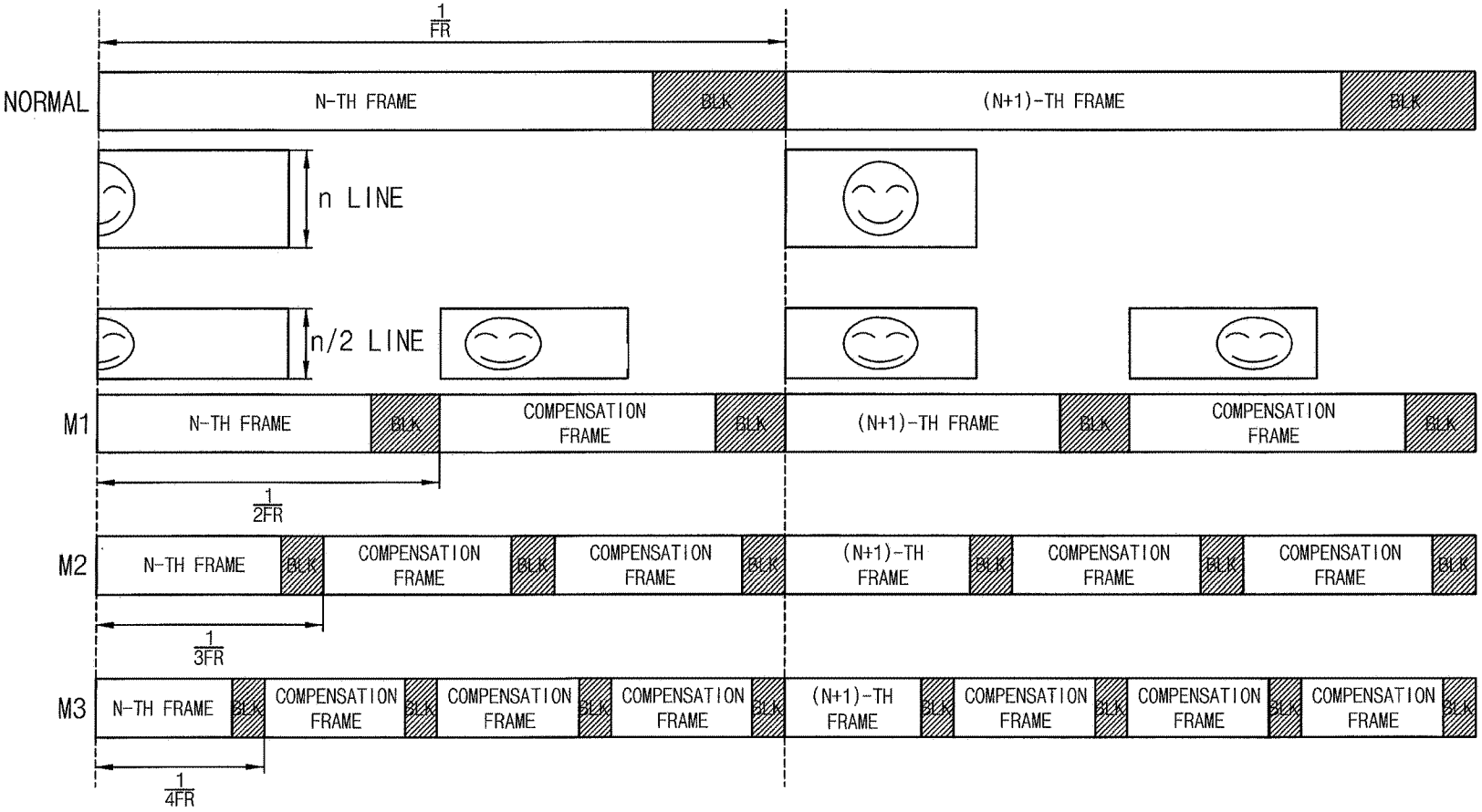
FIG. 9 is a conceptual diagram illustrating structures of frames for the modes.

FIG. 7 is a block diagram illustrating a timing controller of a display apparatus according to an exemplary embodiment of the invention. FIG. 8 is a table illustrating a vertical resolution, a horizontal resolution and a frame frequency for modes. FIG. 9 is a conceptual diagram illustrating structures of frames for the modes.

Referring to FIGS. 1, 2 and 7 to 9, the signal generating part 240 of the timing controller 200 may include a scaler 242, a motion estimated motion compensation ("MEMC") part 244, an image control part 246 and a signal outputting part 248.

The mode determining part 220 determines the pixel perception distance PPD of the user based on the visual information VI. In one exemplary embodiment, for example, the mode determining part 220 determines the pixel perception distance PPD of the user using a following equation: $PPD=A\times CP\times PP/\tan(1/60°)$.

In the above equation, 'A' denotes a user's eyesight (decimal number), 'CP' denotes a variable, and 'PP' denotes a pixel pitch of the display apparatus.

The variable CP is a variable that varies based on a resolution of the input image, an ambient illumination of the display apparatus and the number of users. The variable CP may be set by a manufacturer. The variable CP may be in a range between 0.5 and 1.5. The pixel pitch PP is a pitch of a pixel of the display apparatus. In one exemplary embodiment, for example, the pixel pitch PP may be predetermined by the manufacturer. Alternatively, the pixel pitch PP may be determined based on the size of the display panel, an aspect ratio of the display panel and the resolution of the display apparatus.

In an exemplary embodiment, the mode determining part 220 compares the viewing distance of the user and the pixel perception distance PPD of the user based on the visual information VI. In such an embodiment, when the viewing distance of the user is less than the pixel perception distance PPD of the user, the mode determining part 220 generates a mode selection signal M_SEL representing a normal mode. In such an embodiment, when the viewing distance of the user is greater than the pixel perception distance PPD of the user, the mode determining part 220 generates the mode selection signal M_SEL corresponding to a first mode M1, a second mode M2 or a third mode M3. In one exemplary embodiment, for example, when the viewing distance of the user is greater than the pixel perception distance PPD of the user, the mode determining part 220 generates the mode selection signal M_SEL corresponding to one of the first mode M1, the second mode M2 and the third mode M3 based on the difference between the viewing distance of the user and the pixel perception distance PPD of the user.

The scaler 242 may include a plurality of frame memories (not shown). The scaler 242 receives the mode selection signal M_SEL from the mode determining part 220. The scaler 242 may receive the input image data RGB and the input control signal CONT. The scaler 242 may scale the input image data RGB based on the mode selection signal M_SEL. The scaler 242 may distinguish a static image and a video image in the input image data RGB.

The MEMC part 244 may include a plurality of frame memories (not shown). The MEMC part 244 may insert a compensation frame between two adjacent frames when the display apparatus is driven by one of the first mode M1, the second mode M2 and the third mode M3. The compensation frame may be generated by a MEMC method using image data of the two adjacent frames.

Although not shown in figures, the operation of the MEMC part 244 may be performed prior to the operation of the scaler 242.

The image control part 246 controls the resolution of the image and the frame frequency based on the mode selection signal M_SEL corresponding to the mode. In one exemplary embodiment, for example, the image control part 246 may control the resolution of the image and the frame frequency based on the mode, as shown in FIG. 8.

In an exemplary embodiment, as shown in FIG. 8, the input image may have a vertical resolution of V, a horizontal resolution of H and a frame frequency of FR.

In the normal mode, the vertical resolution, the horizontal resolution and the frame frequency of the input image are maintained to drive the display apparatus. In one exemplary embodiment, for example, in the normal mode, the vertical resolution is V, the horizontal resolution is H, and the frame frequency is FR. A length of the frame is 1/FR in the normal mode.

In the first mode M1, the vertical resolution of the input image is decreased to half, the horizontal resolution of the input image is maintained, and the frame frequency of the input image is doubled to drive the display apparatus. In one exemplary embodiment, for example, in the first mode M1, the vertical resolution is V/2, the horizontal resolution is H, and the frame frequency is 2 FR. A length of the frame is ½ FR in the first mode M1. In the first mode M1, one compensation frame may be inserted between two adjacent frames. The compensation frame may be generated by the MEMC method using the image data of the two adjacent frames.

In the second mode M2, the vertical resolution of the input image is decreased to one third, the horizontal resolution of the input image is maintained, and the frame frequency of the input image is tripled to drive the display apparatus. In one exemplary embodiment, for example, in the second mode M2, the vertical resolution is V/3, the horizontal resolution is H, and the frame frequency is 3 FR. A length of the frame is ⅓ FR in the second mode M2. In the second mode M2, two compensation frames may be inserted between two adjacent frames. The compensation frames may be generated by the MEMC method using the image data of the two adjacent frames and the image data of the compensation frames.

In the third mode M3, the vertical resolution of the input image is decreased to quarter, the horizontal resolution of the input image is maintained and the frame frequency of the input image is quadrupled to drive the display apparatus. In one exemplary embodiment, for example, in third mode M3, the vertical resolution is V/4, the horizontal resolution is H, and the frame frequency is 4 FR. A length of the frame is ¼ FR in the third mode M3. In the third mode M3, three compensation frames may be inserted between two adjacent frames. The compensation frames may be generated by the MEMC method using the image data of the two adjacent frames and the image data of the compensation frames.

The image control part 246 may output the controlled image information corresponding to the mode to the signal outputting part 248.

The signal outputting part 248 may generate the first control signal CONT1, the second control signal CONT2, the third control signal CONT3 and the data signal DAT, based on the controlled image information. The signal outputting part 248 may output the first control signal CONT1, the second control signal CONT2, the third control signal CONT3 and the data signal DAT. In one exemplary embodiment, for example, the signal outputting part 248 may generate the first control signal CONT1, the second control signal CONT2, the third control signal CONT3 and the data signal DAT based on the pixel structure of the display panel 100.

In an alternative exemplary embodiment, although not shown in figures, the mode determining part 220, the scaler 242, the MEMC part 244 and the image control part 246 may be disposed outside the timing controller 200 or formed independently from the timing controller 200. In one exemplary embodiment, for example, the mode determining part 220 may determine the mode, the scaler 242, the MEMC part 244 and the image control part 246 may change the driving characteristics of the input image based on the determined mode and the timing controller 200 may receive the input image data and the input control signal which have the changed driving characteristics corresponding to the determined mode.

Figure 10:
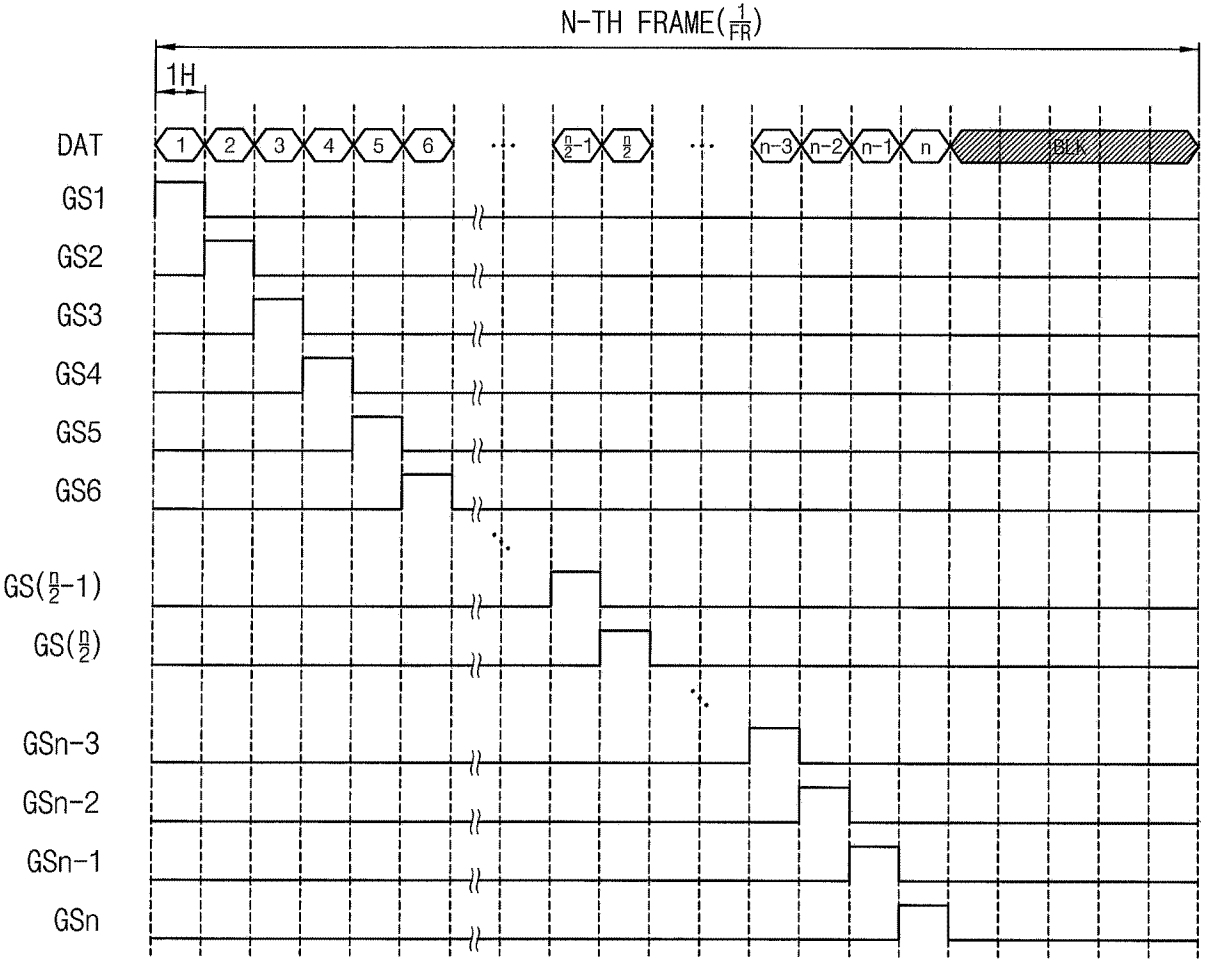
FIG. 10 is a signal timing diagram illustrating a data signal and gate signals of the display apparatus in a frame in a normal mode.

FIG. 10 is a signal timing diagram illustrating a data signal and gate signals of the display apparatus in a frame in a normal mode.

Referring to FIGS. 1, 2, 7 to 10, an exemplary embodiment of the display panel 100 includes n gate lines GL. Here, n is a natural number.

In the normal mode, the gate driver 300 outputs first to n-th gate signals GS1 to GSN to the gate lines GL, respectively. In one exemplary embodiment, for example, the gate driver 300 outputs a first gate signal GS1 to a first gate line during a first horizontal period 1, a second gate signal GS2 to a second gate line during a second horizontal period 2 and an n-th gate signal GSn to an n-th gate line during an n-th horizontal period n.

In the normal mode, the data driver 500 outputs data voltages in synchronous with the first to n-th gate signal GS1 to GSn. In one exemplary embodiment, for example, the data driver 500 outputs data voltages corresponding to a first horizontal line in synchronous with the first gate signal GS1 during the first horizontal period 1, data voltages corresponding to a second horizontal line in synchronous with the second gate signal GS2 during the second horizontal period 2 and data voltages corresponding to an n-th horizontal line in synchronous with the n-th gate signal GSn during the n-th horizontal period n.

Respective high durations of the first to n-th gate signals GS1 to GSn may be one horizontal period 1H in one frame period. During the one horizontal period 1H, the data voltages are charged to the pixels.

Figure 11A:
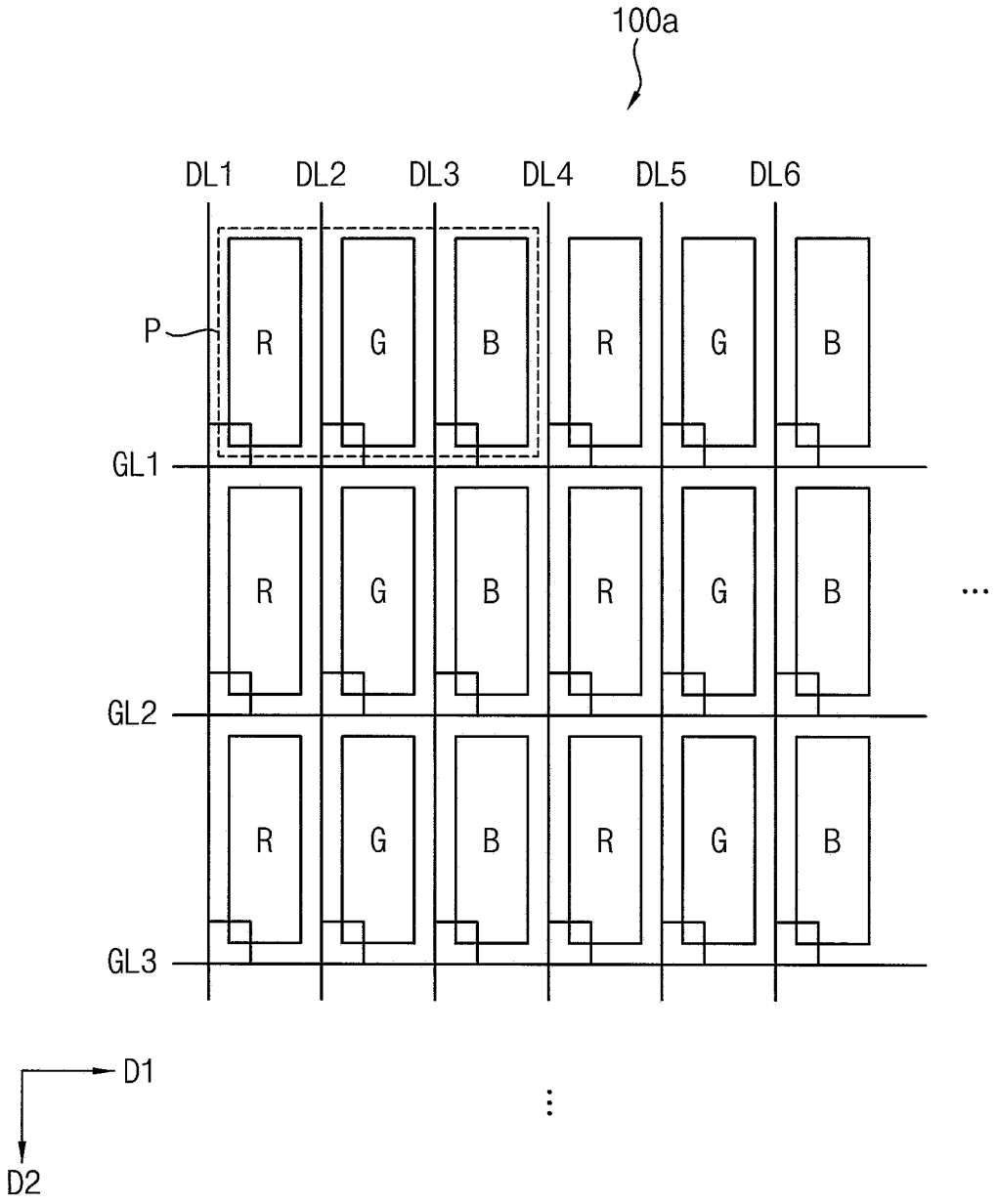
FIG. 11A is a conceptual diagram illustrating a display panel of a display apparatus according to an exemplary embodiment of the invention.
Figure 11B:
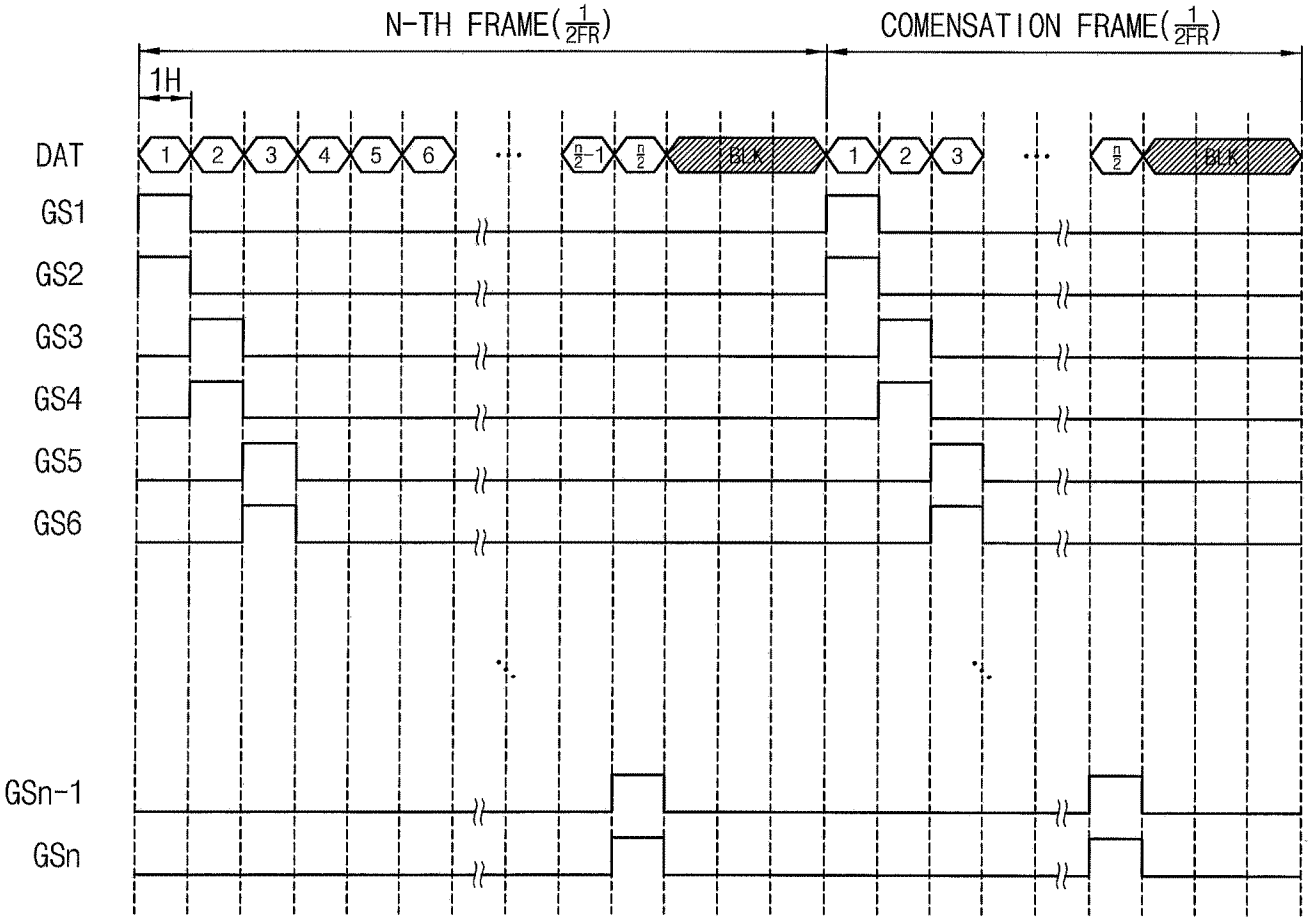
FIG. 11B is a signal timing diagram illustrating a data signal and gate signals of the display apparatus of FIG. 11A in a frame in a first mode.

FIG. 11A is a conceptual diagram illustrating a display panel of a display apparatus according to an exemplary embodiment of the invention. FIG. 11B is a signal timing diagram illustrating a data signal and gate signals of the display apparatus of FIG. 11A in a frame in a first mode.

Referring to FIGS. 1 and 11A, an exemplary embodiment of the display panel 100*a* includes a plurality of unit pixels P. Herein, a pixel may mean a unit pixel. Each unit pixel P includes a plurality of subpixels R, G and B. The subpixels R, G and B may be sequentially disposed along the first direction D1 in the unit pixel P. In one exemplary embodiment, for example, the subpixels R, G and B may be connected to a same gate line GL1 and to corresponding data lines DL1, DL2 and DL3, respectively.

Referring to FIGS. 1, 2, 8, 9, 11A and 11B, an exemplary embodiment of the display panel 100*a* may include n gate lines GL.

In the first mode M1, the gate driver 300 outputs the first to n-th gate signals GS1 to GSn to the gate lines GL, respectively. In one exemplary embodiment, for example, the gate driver 300 outputs a first gate signal GS1 and a second gate signal GS2 during a first horizontal period 1 to a first gate line and a second gate line, outputs a third gate signal GS3 and a fourth gate signal GS4 to a third gate line and a fourth gate line during a second horizontal period 2, and outputs an (n−1)-th gate signal GSn−1 and an n-th gate signal GSn to an (n−1)-th gate line and an n-th gate line during a (n/2)-th horizontal period n/2.

In the first mode M1, the data driver 500 outputs data voltages in synchronous with the first to n-th gate signal GS1 to GSn. In one exemplary embodiment, for example, the data driver 500 outputs data voltages corresponding to a first horizontal line and a second horizontal line in synchronous with the first gate signal GS1 and the second gate signal GS2 during the first horizontal period 1, outputs data voltages corresponding to a third horizontal line and a fourth horizontal line in synchronous with the third gate signal GS3 and the fourth gate signal GS4 during the second horizontal period 2, and outputs data voltages corresponding to an (n−1)-th horizontal line and an n-th horizontal line n in synchronous with the (n−1)-th gate signal GSn−1 and the n-th gate signal GSn during the (n/2)-th horizontal period n/2.

During the compensation frame of the first mode M1, the gate signals and the data voltages having substantially the same timing as each other may be outputted.

Respective high durations of the first to n-th gate signals GS1 to GSn may be one horizontal period 1H. During the one horizontal period 1H, the data voltages are charged to the pixels.

Figure 12A:
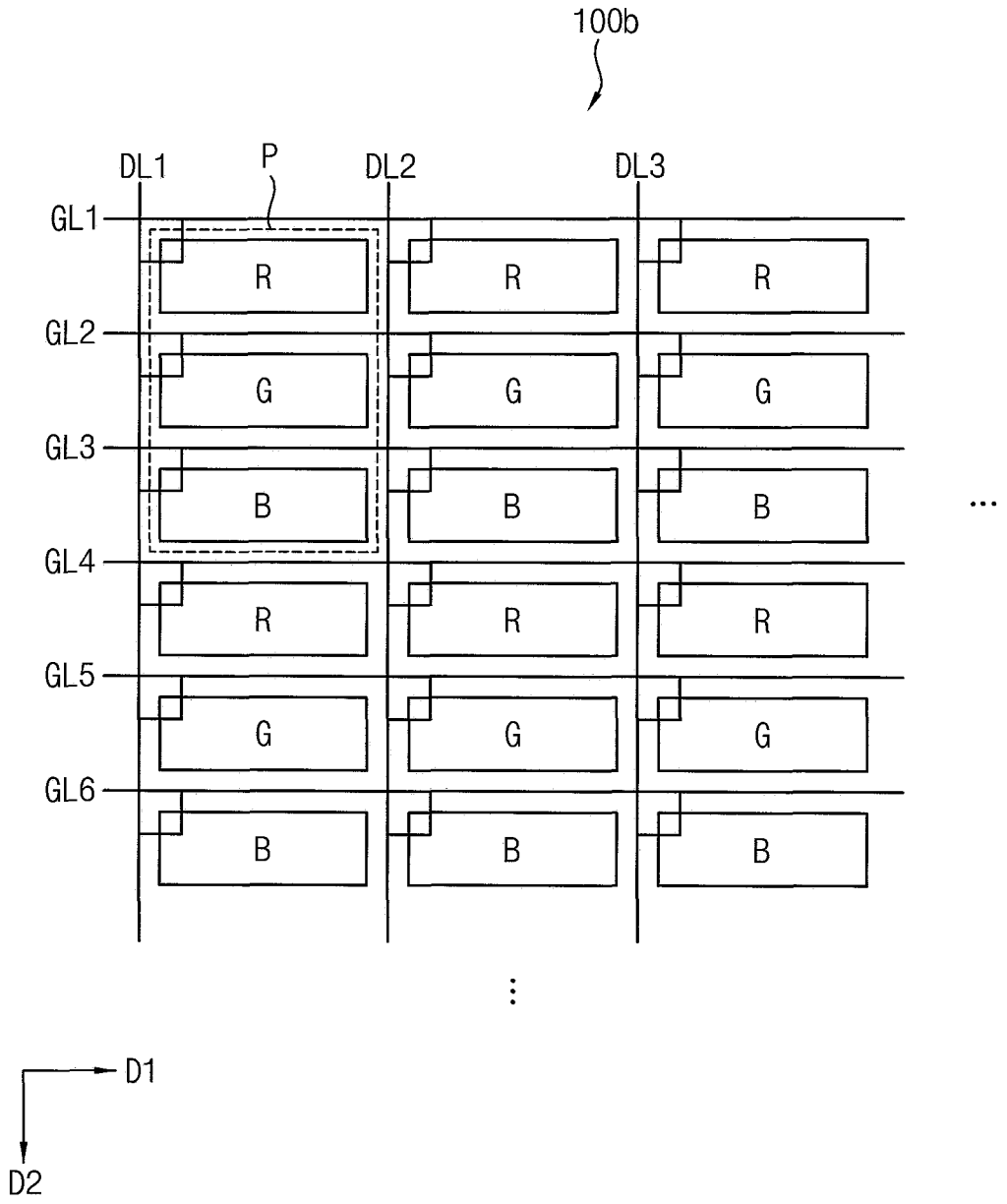
FIG. 12A is a conceptual diagram illustrating a display panel of a display apparatus according to an alternative exemplary embodiment of the invention.
Figure 12B:
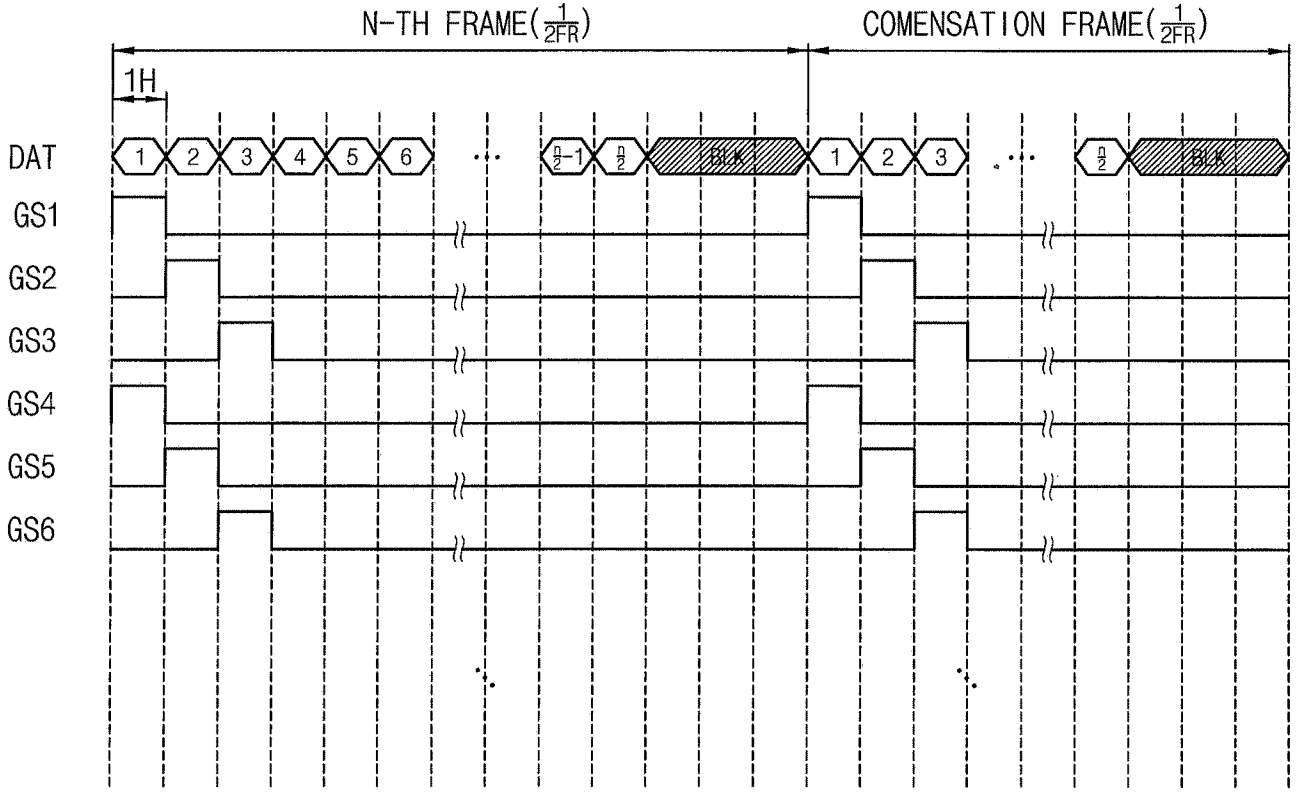
FIG. 12B is a signal timing diagram illustrating a data signal and gate signals in a frame of the display apparatus of FIG. 12A in a first mode.

FIG. 12A is a conceptual diagram illustrating a display panel of a display apparatus according to an alternative exemplary embodiment of the invention. FIG. 12B is a signal timing diagram illustrating a data signal and gate signals in a frame of the display apparatus of FIG. 12A in a first mode.

Referring to FIGS. 1 and 12A, an exemplary embodiment of the display panel 100*b* includes a plurality of unit pixels P. Each unit pixel P includes a plurality of subpixels R, G and B. The subpixels R, G and B may be sequentially disposed along the second direction D2 in the unit pixel P. In one exemplary embodiment, for example, the subpixels R, G and B may be connected to a same data line DL1 and to corresponding gate lines GL1, GL2 and GL3, respectively.

In one exemplary embodiment, for example, first and fourth gate lines GL1 and GL4 may be connected to corresponding red subpixels R. Second and fifth gate lines GL2 and GL5 may be connected to corresponding green subpixels G Third and sixth gate lines GL3 and GL6 may be connected to corresponding blue subpixels B.

Referring to FIGS. 1, 2, 8, 9, 12A and 12B, in the first mode M1, the gate driver 300 outputs the first to n-th gate signals GS1 to GSn to the respective gate lines GL. In one exemplary embodiment, for example, the gate driver 300 outputs a first gate signal GS1 and a fourth gate signal GS4 during a first horizontal period 1 to the first gate line GL1 and the fourth gate line GL4, outputs a second gate signal GS2 and a fifth gate signal GS5 to the second gate line GL2 and the fifth gate line GL5 during a second horizontal period 2, and outputs a third gate signal GS3 and a sixth gate signal GS6 to the third gate line GL3 and the sixth gate line GL6 during a third horizontal period 3.

In the first mode M1, the data driver 500 outputs data voltages in synchronous with the first to n-th gate signal GS1 to GSn. In one exemplary embodiment, for example, the data driver 500 outputs data voltages corresponding to a first horizontal line and a fourth horizontal line in synchronous with the first gate signal GS1 and the fourth gate signal GS4 during the first horizontal period 1, outputs data voltages corresponding to a second horizontal line and a fifth horizontal line in synchronous with the second gate signal GS2 and the fifth gate signal GS5 during the second horizontal period 2, and outputs data voltages corresponding to a third horizontal line and a sixth horizontal line in synchronous with the third gate signal GS3 and the sixth gate signal GS6 during the third horizontal period 3.

During the compensation frame of the first mode M1, the gate signals and the data voltages having substantially the same timing as each other may be outputted.

Respective high durations of the first to n-th gate signals GS1 to GSn may be one horizontal period 1H. During the one horizontal period 1H, the data voltages are charged to the pixels.

In the first mode M1, two gate lines may be simultaneously driven in a single horizontal period, that is, the two gate lines may be driven during a same horizontal period. Accordingly, the vertical resolution may be decreased to half and the frame frequency may be doubled.

Although not shown in figures, in the second mode M2, three gate lines may be simultaneously driven in a single horizontal period. Accordingly, the vertical resolution may be decreased to one third and the frame frequency may be tripled. Although not shown in figures, in the third mode M3, four gate lines may be simultaneously driven in a single horizontal period. Accordingly, the vertical resolution may be decreased to quarter and the frame frequency may be quadrupled.

Exemplary embodiments of the display apparatus may be applied to various devices and systems. Exemplary embodiments of the display apparatus may be applied to a cellular phone, a smart phone, a tablet personal computer ("PC"), a smart pad, a personal digital assistant ("PDA"), a portable media player ("PMP"), a digital camera, a camcorder, a personal computer, a server computer, a workstation, a laptop computer, a digital television, set-top box, an MP3 player, a portable game console, a navigation system, a smart card, a printer and so on, for example.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a visual information inputting part which receives an eyesight of a user and a viewing distance of the user;

a mode determining part which determines a pixel perception distance of the user based on the eyesight of the user, and selects one of a normal mode and a control mode by comparing the viewing distance of the user and the pixel perception distance;

a driver which maintains a vertical resolution of an input image and a frame frequency of the input image, when the normal mode is selected, and which outputs at least two gate signals of a plurality of gate signals to corresponding gate lines of a plurality of gate lines during a same horizontal period to decrease the vertical resolution of the input image and inserts a compensation frame between adjacent frames to increase the frame frequency of the input image, when the control mode is selected; and a display panel which displays an image based on the vertical resolution and the frame frequency set by the driver, wherein the pixel perception distance satisfies the following equation: $PPD=A\times CP\times PP/\tan(1/60°)$, wherein PPD denotes the pixel perception distance, A denotes the eyesight of the user in a decimal number, CP denotes a variable, and PP denotes a pixel pitch of the display apparatus.

2. The display apparatus of claim 1, wherein the mode determining part selects the normal mode when the viewing distance is less than the pixel perception distance, and selects the control mode when the viewing distance is greater than the pixel perception distance.

3. The display apparatus of claim 1, wherein the display panel includes the plurality of gate lines extending in a first direction, a plurality of data lines extending in a second direction crossing the first direction, and a plurality of pixels connected to the plurality of gate lines and the plurality of data lines, each of the pixels includes a plurality of subpixels, the subpixels are disposed in the first direction in the pixel, and the driver outputs the at least two gate signals to adjacent gate lines of the plurality of gate lines during the same horizontal period in the control mode.

4. The display apparatus of claim 1, wherein the display panel includes the plurality of gate lines extending in a first direction, a plurality of data lines extending in a second direction crossing the first direction, and a plurality of pixels connected to the plurality of gate lines and the plurality of data lines, each of the pixels includes a plurality of subpixels, the subpixels are disposed in the second direction in the pixel, and the driver outputs the at least two gate signals to gate lines connected to subpixels having a same color as each other during the same horizontal period in the control mode.

5. The display apparatus of claim 1, wherein the control mode includes a first mode, a second mode and a third mode.

6. The display apparatus of claim 5, wherein the driver outputs two gate signals to two gate lines during the same horizontal period to decrease the vertical resolution of the input image to half, and inserts a single compensation frame between adjacent frames to double the frame frequency of the input image in the first mode.

7. The display apparatus of claim 5, wherein the driver outputs three gate signals to three gate lines during the same horizontal period to decrease the vertical resolution of the input image to one third, and inserts two compensation frames between adjacent frames to triple the frame frequency of the input image in the second mode.

8. The display apparatus of claim 5, wherein the driver outputs four gate signals to four gate lines during the same horizontal period to decrease the vertical resolution of the input image to quarter, and inserts three compensation frames between adjacent frames to quadruple the frame frequency of the input image in the third mode.

9. The display apparatus of claim 5, wherein the mode determining part selects one of the first mode, the second mode and the third mode based on a difference between the viewing distance and the pixel perception distance.

10. The display apparatus of claim 1, wherein the visual information inputting part displays an eyesight test pattern to perform an eyesight test, and determines the eyesight of the user based on a result from the eyesight test.

11. The display apparatus of claim 1, wherein the visual information inputting part determines the viewing distance of the user using a camera.

12. The display apparatus of claim 1, wherein the visual information inputting part receives an ambient illumination of the display apparatus and a number of users, and the variable (CP) is determined based on a resolution of the input image, the ambient illumination and the number of users, wherein the variable (CP) is in a range between 0.5 and 1.5.

13. The display apparatus of claim 1, wherein the pixel pitch (PP) is a length of a side of the pixel.

14. The display apparatus of claim 1, wherein the compensation frame is generated by a motion estimated motion compensation method using image data of the adjacent frames.

15. The display apparatus of claim 1, wherein the mode determining part selects one of the normal mode and the control mode to generate a mode selection signal, and the driver comprises:

a scaler which scales input image data based on the mode selection signal;

a motion estimated motion compensation part which generates the compensation frame by a motion estimated motion compensation method using image data of the adjacent frames in the control mode; and an image control part which controls the vertical resolution and the frame frequency based on the mode selection signal.

16. A display apparatus comprising:

a visual information inputting part which receives an eyesight of a user and a viewing distance of the user;

a mode determining part which determines a pixel perception distance of the user based on the eyesight of the user and selects a control mode when the viewing distance is greater than the pixel perception distance;

a driver which outputs n gate signals to n gate lines during a same horizontal period in the control mode to decrease a vertical resolution of an input image by 1/n, and inserts (n−1) compensation frames between adjacent frames to increase a frame frequency of the input image by n times, wherein n is a positive integer greater than 1; and a display panel which displays an image based on the vertical resolution and the frame frequency set by the driver, wherein the pixel perception distance satisfies the following equation: $PPD=A\times CP\times PP/\tan(1/60°)$, wherein PPD denotes the pixel perception distance, A denotes the eyesight of the user in decimal number, CP denotes a variable, and PP denotes a pixel pitch of the display apparatus.

17. A method of driving a display apparatus, the method comprising:

receiving an eyesight of the user and a viewing distance of the user;

determining a pixel perception distance of the user based on the eyesight of the user;

comparing the viewing distance and the pixel perception distance to select one of a normal mode and a control mode;

displaying an image with a normal vertical resolution of an input image and a normal frame frequency of the input image, when the normal mode is selected; and displaying the image with a vertical resolution lower than the normal vertical resolution by outputting at least two gate signals of a plurality of gate signals to corresponding gate lines of a plurality of gate lines during a same horizontal period and with a frame frequency greater than the normal frame frequency by inserting a compensation frame between adjacent frames, when the control mode is selected;

wherein the pixel perception distance satisfies the following equation: $PPD=A\times CP\times PP/\tan(1/60°)$, wherein PPD denotes the pixel perception distance, A denotes the eyesight of the user in decimal number, CP denotes a variable, and PP denotes a pixel pitch of the display apparatus.

18. The method of claim 17, wherein the normal mode is selected when the viewing distance is less than the pixel perception distance, and the control mode is selected when the viewing distance is greater than the pixel perception distance.

19. The method of claim 17, wherein the receiving the eyesight of the user and the viewing distance of the user comprises:

displaying an eyesight test pattern to perform an eyesight test; and determining the eyesight of the user based on a result from the eyesight test.

20. The method of claim 17, wherein the inserting the compensation frame between the adjacent frames comprises:

generating the compensation frame by a motion estimated motion compensation method using image data of the adjacent frames.

* * * * *